US007774861B1

(12) United States Patent
Schmidt

(10) Patent No.: US 7,774,861 B1
(45) Date of Patent: Aug. 17, 2010

(54) COMPRESSED CELLULOSE POP-UP SPONGE HEAD OR BODY BAND AND METHOD OF USE

(76) Inventor: Donald H. Schmidt, 14745 Major Ave., Oak Forest, IL (US) 60452

( * ) Notice: Subject to any disclaimer, the term of this patent is extended or adjusted under 35 U.S.C. 154(b) by 0 days.

(21) Appl. No.: 12/001,839

(22) Filed: Dec. 12, 2007

(51) Int. Cl.
*A42C 5/02* (2006.01)

(52) U.S. Cl. ..... 2/181; 2/181.4; 2/182.3; 2/182.8; 2/181.2; 2/181.6

(58) Field of Classification Search ..... 2/171, 2/181, 181.4, 182.3, 182.8, 181.2, 181.6, 2/181.8
See application file for complete search history.

(56) References Cited

U.S. PATENT DOCUMENTS

| | | | | |
|---|---|---|---|---|
| 2,223,332 | A | 11/1940 | Sterne | |
| 2,783,474 | A | 3/1957 | Campagna et al. | |
| 2,825,328 | A | 3/1958 | Olsen | |
| 3,466,664 | A | 9/1969 | Militello | |
| 4,833,734 | A * | 5/1989 | Der Estephanian | 2/171 |
| 4,856,116 | A | 8/1989 | Sullivan | |
| 5,146,630 | A | 9/1992 | Richard | |
| 5,377,360 | A * | 1/1995 | Fleitman | 2/181 |
| 5,826,277 | A | 10/1998 | McConville | |
| 6,115,844 | A * | 9/2000 | Cho | 2/181 |
| 6,477,715 | B2 | 11/2002 | Shin | |
| 6,738,985 | B2 | 5/2004 | Hahn et al. | |
| 2002/0100107 | A1 | 8/2002 | Shin | |
| 2007/0163027 | A1 * | 7/2007 | Hamilton | 2/171 |

* cited by examiner

*Primary Examiner*—Gary L Welch
*Assistant Examiner*—Alissa J Tompkins
(74) *Attorney, Agent, or Firm*—Justin Lampel

(57) ABSTRACT

A non-fabric head or body band is made from compressed cellulose pop-up sponge material for cooling the wearer. The band comprises a reversible strip of pop-up sponge material in which one or more holes or passageways are formed, the ends of which are connected by an elastic band. The band is wetted causing the pop-up sponge material to expand, such that the inner and outer surfaces are approximately $\frac{5}{8}^{th}$ of an inch apart, between which is held a supply of water/liquid. The inner surface is substantially in contact with the wearer, while the outer surface is exposed to the elements. During the cooling process, the strip draws heat and/or sweat away from the user, into the cellulose material, and toward the outer surface of the strip, allowing relatively rapid evaporation of sweat and dissipation of heat from the cellulose material as it is cooled from exposure to the elements. The band can repeatedly be reversed to provide a further cooling effect by placing the cooler side of the strip against the user and in turn exposing the warmer/sweat side to the elements, thereby recycling the cooling process.

5 Claims, 5 Drawing Sheets

COMPRESSED CELLULOSE POP-UP SPONGE HEAD OR BODY BAND AND METHOD OF USE

The present disclosure relates generally to bands worn on the head or body, and in particular, to a non-fabric band for cooling the wearer. Specifically, the present disclosure relates to a reversible headband, wristband or the like made from a strip of compressed cellulose pop-up sponge material, a securing strip of elastic, and one or more air/evaporation holes or passageways formed in the strip of compressed cellulose pop-up sponge material, wherein the use of the band in connection with water or the like provides an enhanced cooling effect to the user.

BACKGROUND OF THE INVENTION

The most common type of band worn on a person's head, wrist, etc. is the sweatband. Sweatbands have long been known and worn by users during physical activity such as running, biking and playing sports of all kinds such as basketball, tennis, etc. Typically, an initially dry sweatband is placed around the head of a user to absorb sweat and keep sweat from running down the user's face and from entering the user's eyes. However, typical sweatbands do not provide a cooling effect to the user, and may in fact trap heat, producing an undesirable warming or heating effect on the user. Further, typical sweatbands can become saturated with sweat and lose their intended effectiveness. Additionally, typical sweatbands are tight and can be uncomfortable to wearer.

The most common type of sweatband is a stretchable cloth type sweatband, usually formed from a blend of mostly cotton and a smaller percentage of an elastic material such as Lycra. There have also been numerous other attempts in the prior art to provide sweatbands of various forms and configurations. However, such attempts typically have resulted in sweatbands which are complicated and difficult to use or manufacture, and which are uncomfortable to the wearer. Further, such known prior art sweatbands are designed primarily for the absorption of sweat, and do not provide a cooling effect to the user.

For example, U.S. Pat. No. 6,738,985 B2 issued on May 25, 2004 to Hahn et al. discloses a disposable moisture absorbing sweatband liner affixable to a cap, hat or sun visor by adhesive material. The liner is made from moisture absorbing material such as cotton terrycloth.

U.S. Pat. No. 6,477,715 B2 issued on Nov. 12, 2002 to Shin, and U.S. Patent Application Publication No. US 2002/0100107 A1 published on Aug. 1, 2002 to Shin, disclose a detachable, disposable sweatband which attaches to the interior of existing hardware such as a cap. The sweatband is comprised of a core of special highly-absorptive material, based on the basic principles of feminine hygiene pads.

U.S. Pat. No. 5,826,277 issued on Oct. 27, 1998 to McConville discloses a sweatband comprising an elastic band to which is sewn a length of sponge cloth intermittently along spaced apart locations on the elastic band. A tubular fabric wrap surrounds the elastic band and the sponge cloth.

U.S. Pat. No. 5,146,630 issued on Sep. 15, 1992 to Richard discloses a sweatband comprised of a fabric band to which are attached a second and third piece of fabric to form a pocket. A package of granular moisture absorbing material is removably placed within the pocket.

U.S. Pat. No. 4,856,116 issued on Aug. 15, 1989 to Sullivan discloses a sweatband comprising a first component having a moisture absorbing core covered with a soft, pliable material, and a second component having an elastically extensible member surrounded by a cover. A visor may be attached to the first component.

U.S. Pat. No. 3,466,664 issued on Jun. 22, 1969 to Militello discloses a sweatband comprising an outer layer of sponge material in face to face contact with a metal foil layer. An inner layer of gauze is stitched to the sponge material to cover and retain the metal foil layer therebetween. The metal foil layer and sponge layer may include perforations to provide a certain amount of air circulation.

U.S. Pat. No. 2,825,328 issued on Mar. 4, 1958 to Olsen discloses a scalp loosening tension band for the purpose of preserving hair. The band comprises an outer vulcanized rubber tension band and a cushioned lining. The outer rubber tension band may have ventilating and air circulating holes.

U.S. Pat. No. 2,783,474 issued on Mar. 5, 1957 to Campagna et al. discloses a fibrous and absorbent perspiration pad comprising a loose, fibrous, absorbent carded batt center and a fused edge supporting area. A cloth layer is provided on one or both sides of the absorbent center and edge area.

U.S. Pat. No. 2,223,332 issued on Nov. 26, 1940 to Sterne discloses a cellulose and fibrous absorbent pad having a band extending across the front of the entire pad, and having binding strips at the ends of the pad. Alternatively, the absorbent pad is removably mounted on the inner face of the band and retained in place by loops.

While such prior art bands may generally fulfill their intended uses, there are numerous disadvantages in their use and construction. For example, these known bands do not provide any distinct cooling effect from a plurality of passageways through a relatively thick material, and may actually cause a heating effect. Further, these known bands may become ineffective after a relatively short period of use. Additionally, these known bands can be difficult or costly to manufacture, and may not be very durable. Also, these known bands can be uncomfortably to wear and/or relatively difficult or cumbersome to put on and/or take off. Still further, these known bands may not be suitable for physical activity and thus may not maintain their structural integrity during use.

Accordingly, in today's environment and with the heating of the Earth, there is an immediate need for a head or body band which provides a repeated cooling effect to the user, which is fast and easy to put on and take off, which is relatively sturdy and durable, which is easy and inexpensive to manufacture, and which is easy to use and does not lose its effectiveness during use, especially during physical activity. The present invention fulfills such needs, and provides numerous other benefits and advantages with respect to head or body bands.

BRIEF SUMMARY OF THE INVENTION

The present disclosure relates to non-fabric head or body bands, and in particular, to compressed cellulose pop-up sponge head or body (wrist, elbow, knee, etc.) bands for cooling the wearer. Specifically, disclosed herein are one or more embodiments of a band made from a reversible strip of compressed cellulose, pop-up sponge material in which one or more holes or passageways are formed, the ends of which are connected by an elastic band.

The compressed cellulose pop-up sponge material, before it is wet, is a thin piece of material that can be easily fabricated, unlike typical sponge material. When wet, the compressed cellulose pop-up sponge material pops up or expands in thickness to approximately five times its initial thickness. This increased thickness provides a suitable area for holding a good supply of water/sweat between the surface adjacent to the wearer and the outer exposed surface of the band, allowing for an evaporation cooling effect to take place. The inner surface in contact with the wearer absorbs sweat and transfers heat off the wearer. At the same time, the outer surface which is now spaced approximately $5/8^{th}$ of an inch away from the wearer, is more independently exposed to the elements, thereby accelerating the evaporation process at the outer surface and creating the cooling effect. The heat of the wearer travels toward this cooler area aided by the air passageways in the band.

Thus, the use of the compressed cellulose pop-up sponge band provides a cooling effect to the user by drawing heat and/or sweat away from the user, into the popped-up cellulose material, and toward the outer surface of the strip. The outer surface of the strip and the perimeter surfaces of the holes/passageways formed in the strip remain exposed to the elements, allowing relatively rapid evaporation of sweat and dissipation of heat from the cellulose material. At the same time, the outer surface of the strip is cooled from exposure to the elements. As such, the band can be advantageously reversed, providing a further cooling effect by placing the cooler side of the strip against the user. This process can be repeated as needed to continuously provide a cooling effect to the wearer.

Accordingly, it is the principal object of the present disclosure to provide a non-fabric head or body band for cooling the wearer.

It is a further object of the present disclosure to provide a reversible, compressed cellulose pop-up sponge band in which a plurality of holes or passageways are formed, the ends of which are connected by an elastic band.

It is also an object of the present disclosure to provide a reversible, compressed cellulose pop-up sponge head or body band which provides a cooling effect to the user, which is fast and easy to put on and take off, which is relatively sturdy and durable, which is easy and inexpensive to manufacture, and which is easy to use and does not lose its effectiveness during use, especially during physical activity.

Numerous other advantages and features of the present disclosure will become readily apparent from the following detailed description, from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE DISCLOSED EMBODIMENT

Figure 1A:
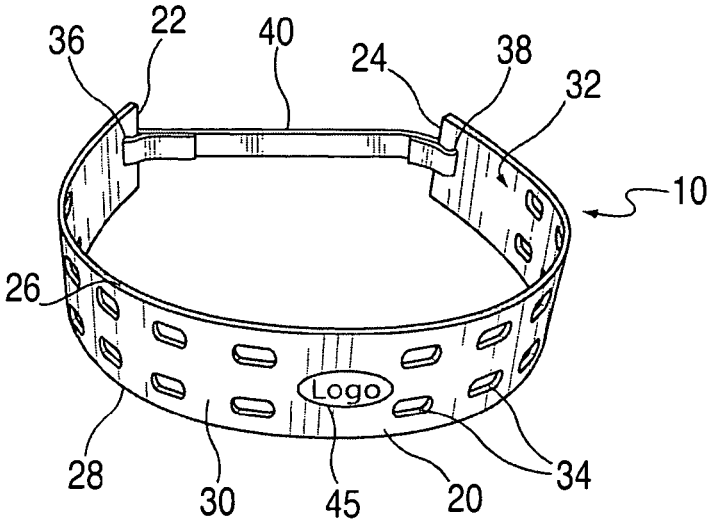
FIG. 1A is a perspective view of a preferred embodiment of a compressed cellulose pop-up sponge head band of the present disclosure, in an unexpanded state.

While the invention is susceptible of embodiment in many different forms, there is shown in the drawings and will be described herein in detail one or more embodiments of the present disclosure. It should be understood, however, that the present disclosure is to be considered an exemplification of the principles of the invention, and the embodiment(s) illustrated is/are not intended to limit the spirit and scope of the invention and/or the claims herein.

FIG. 1A illustrates a first embodiment of the present disclosure wherein the compressed cellulose pop-up sponge band 10 takes the form of a head band. The band 10 comprises a generally rectangular strip 20 of compressed cellulose pop-up sponge material. The strip 20 has a first end 22, a second end 24, a first edge 26, a second edge 28, a first surface 30 and a second surface 32.

A plurality of holes or passageways 34 are formed in the strip 20. Two additional holes 36, 38 are formed near the ends 22, 24 respectively. These two holes 36, 38 provide the attachment locations for an elastic band 40, which connects end 22 with end 24, as can be seen in FIG. 1A. A logo, name, symbol or other indicia 45 may be printed on or otherwise affixed to one or both of the surfaces 30, 32 of the strip 20, preferably but not necessarily at or near the center of the strip 20. The strip 20 can be of any color or colors or have printed patterns or other designs thereon.

Figure 1B:
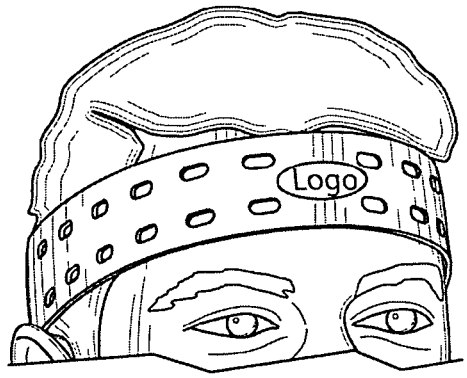
FIG. 1B is a perspective view of the preferred embodiment of the compressed cellulose pop-up sponge head band of the present disclosure, in an unexpanded state, in use on a wearer's head.

As can be seen in FIG. 1B, the band 10 is worn in the manner of a head band, wherein the strip 20 is place on the wearer's head. In this embodiment, the strip 20 extends approximately from a location approximately behind the wear's ear and around the forehead of the wearer at approximately the wearer's hairline, to a location approximately behind the wearer's other ear, encircling approximately 80% of the wearer's head. Elastic band 40 (see FIG. 1A) extends across the back of the wearer's head connecting the ends 22, 24 of the strip 20, and snugly yet comfortably holds the band 10 on the wearer's head due to the resistance of the elastic band. One of the first and second surfaces 30, 32 lies directly in contact with and on the wearer's head. The other of the first and second surfaces 30, 32 which is not directly contacting the wearer's head, remains exposed to the elements. Additionally, portions of the wearer's head behind the strip 20 remain directly exposed to the elements through the plurality of holes 34 in the strip 20.

Preferably, the strip 20 is comprised of commercially available, compressed cellulose pop-up sponge material. One such commercially available material comprises approximately 76.0% cellulose, 7.7% polyol, and 15.5% sodium chloride (NaCL) in total sponge weight. Polyol is a humectant mixture containing sugar-like compounds derived from sorbital and glucose. It should be understood however that the strip 20 could be made from other similar material so long as it accomplishes the function, purposes and/or advantages of the invention disclosed herein.

Accordingly, in the embodiment illustrated in FIGS. 1A-1D, the strip 20, when dry, initially measures approximately seventeen (17) inches in length, approximately one and a half (1½) inches in width, and approximately one sixteenth ($1/16^{th}$) of an inch in thickness. These measurements are contemplated for an adult sized head band, but can be varied to accommodate various sized heads. When fully wetted, the compressed cellulose pop-up sponge material expands in thickness or pops-up to approximately five eights ($5/8^{th}$) of an inch thick, providing a suitable distance between the inner and outer surfaces to allow for the simultaneous, spaced apart absorption of heat and/or sweat at the inner surface and the evaporation cooling at the outer surface. It should be understood that the band could take any suitable size and shape as desired, and other lengths, widths and thicknesses could be used so long as it accomplishes the function, purposes and/or advantages of the invention disclosed herein.

Similarly, the plurality of holes or passageways 34 formed in the strip 20 could take any suitable shapes or sizes, but preferably are elongated, horizontal ovals measuring approximately one half (½) of an inch in length and approximately one quarter (¼) of an inch in height. Any suitable number of these holes can be cut or punched into the strip in suitable locations along the strip. As illustrated, the strip 20 has twenty four (24) of such holes or passageways arranged in two (2) symmetric rows, twelve (12) holes per row, with six (6) holes to the left of center and six (6) holes to the right of center in each row.

Additionally, the two holes 36, 38 providing the attachment locations for the elastic band 40 connecting end 22 with end 24 are cut or punched into the strip 20 approximately three eights (⅜) of an inch in from the ends of the strip, respectively. These attachment holes 36, 38 are preferably the same size and shape as the other holes 34, but are oriented vertically rather than horizontally.

The strip 20 or a plurality of strips can easily be fabricated from a sheet, usually one square yard, of compressed cellulose pop-up sponge material using a steel rule die or other cutting implement. The holes 34 can be die cut or otherwise cut or punched through the compressed cellulose pop-up sponge material.

The elastic band 40 preferably comprises a piece of elastic approximately one half (½) of an inch wide and approximately six (6) inches long. The ends of the elastic band 40 are inserted through the attachment holes 36 and 38, respectively, and then an approximately one (1) inch section of each end of the elastic band 40 is doubled over onto itself, each around the respective end of the strip 20. Each doubled over portion of the elastic band 40 is then suitably glued together, such as with a hot melt glue, or otherwise suitably fastened to secure the elastic band 40, now approximately four (4) inches long, to each end of the strip 20. The looping of the elastic band 40 around the ends 22, 24 of the strip 20 through attachment holes 36, 38 provides a soft, elastic pull on the pop-up sponge material without tearing the pop-up sponge material.

Figure 1C:
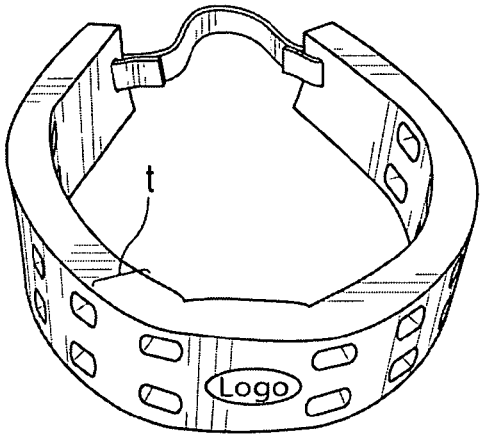
FIG. 1C is a perspective view of the preferred embodiment of the compressed cellulose pop-up sponge head band of the present disclosure, in an expanded state.
Figure 1D:
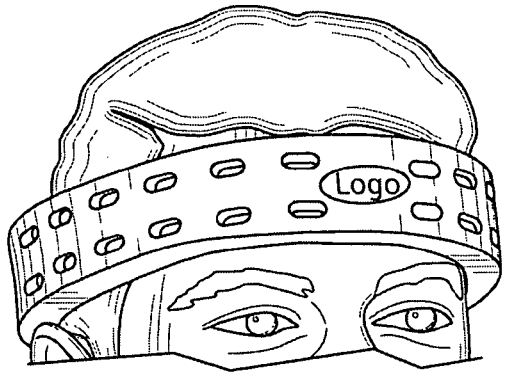
FIG. 1D is a perspective view of the preferred embodiment of the compressed cellulose pop-up sponge head band of the present disclosure, in an expanded state, in use on a wearer's head.

Preferably, the band 10 is wetted prior to being worn, so there is a spacing or distance created by the thickness (t) of the expanded sponge material between the wearer's head and the outer, exposed surface of the strip 20. The user can soak the band 10 in cold water, thus expanding the strip 20 as shown in FIG. 1C. The user can then squeeze the excess water from the strip 20, resulting in a cold, damp popped-up sponge which can be wore by the user, as illustrated in FIG. 1D, to cool off the user, for example, during physical activity or simply on a hot day. Alternatively, the band 10 can be used initially dry, in which case it will expand as it absorbs the wearer's perspiration. However, without the expanded thickness holding a supply of water/sweat, the heat absorption and cooling effect are relatively low.

As water evaporates off of the band 10 from the front, where the sun, wind, and/or other elements act on the band, a cooling of the band takes place to provide a cooling effect to the wearer's head. The heat from the wearer's head is taken up by the sponge material and passes through the sponge, aided by the holes 34. The holes 34 provide a greater exposed surface area of the sponge material allowing for increased or accelerated evaporation, and also provide a direct passageway through the sponge material for heat exchange. As heat flows to cold, the heat from the wearer's head flows toward the cooler outer portion of the sponge, thus cooling the head. Additionally, any wind or a cool breeze can directly reach the user through the plurality of holes 34, resulting in additional cooling.

Additionally, the band 10 is easily reversible to provide a further cooling effect to the user. The band 10, which is essentially symmetrical inside and out, comprising only the strip and the elastic band, can easily be flipped so that the cooler outer portion of the strip 20 thus comes into contact with the head of the wearer, providing an instant cooling effect. The surface of the strip 20 which had been contacting the wearer, now on the outer side after being flipped, has more water or perspiration as it was against the wearer's head, and begins the evaporation and heat transfer process to once again provide further cooling to the user. Accordingly, the band 10 can be repeatedly flipped or reversed time and again, allowing the band 10 to continue to provide a cooling effect for a prolonged period of time. There are no interfering parts which would prevent the band from being flipped over and functioning the same way on either side, whether flipped to one surface or the other surface.

Figure 2A:
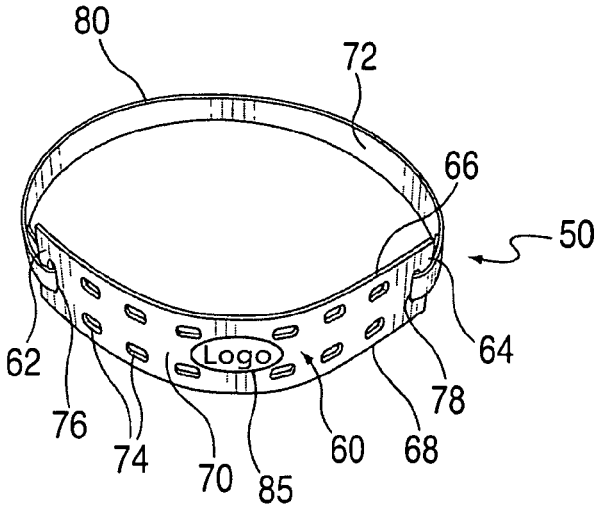
FIG. 2A is a perspective view of an alternate embodiment of a compressed cellulose pop-up sponge head band of the present disclosure, in an unexpanded state, for use under a wearer's hat or cap.

Again, the compressed cellulose pop-up sponge band can be fabricated in any desired size, shape and/or configuration. For example, FIG. 2A illustrates a second embodiment of the present disclosure wherein a compressed cellulose pop-up sponge band 50 takes the form of a cap band, i.e., a band designed to be worn under a baseball hat or cap, or similar headwear such as a visor or the like. The band 50 comprises a generally rectangular strip 60 of compressed cellulose pop-up sponge material. The strip 60 has a first end 62, a second end 64, a first edge 66, a second edge 68, a first surface 70 and a second surface 72 (back side of band in FIG. 2A).

A plurality of holes or passageways 74 are formed in the strip 60. Two additional holes 76, 78 are formed near the ends 62, 64 respectively. These two holes 76, 78 provide the attachment locations for an elastic band 80, which connects end 62 with end 64, as can be seen in FIG. 2A. A logo, name, symbol or other indicia 85 may be printed on or otherwise affixed to one or both of the surfaces 70, 72 of the strip 60, preferably but not necessarily at or near the center of the strip 60.

Figure 2B:
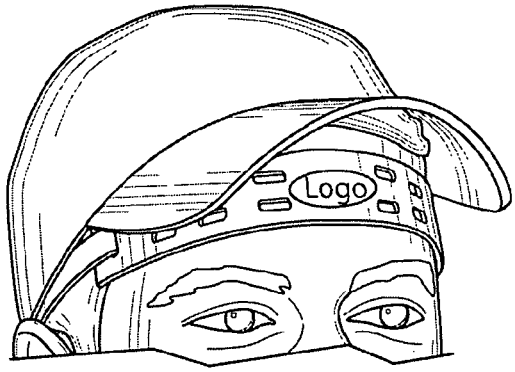
FIG. 2B is a perspective view of the alternate embodiment of the compressed cellulose pop-up sponge head band of the present disclosure, in an unexpanded state, for use under a wearer's hat or cap, and in use on a wearer's head.

As can be seen in FIG. 2B, the band 50 is worn as a head band, specifically designed to fit under a wearer's cap or the like, wherein the strip 60 is placed on the wearer's head under the brim of the cap. In this embodiment, the strip 60 extends approximately from a location approximately at the temple area of the wearer and around the forehead of the wearer at approximately the wearer's capline, to a location approximately at the wearer's other temple area, encircling approximately 40-50% of the wear's head. Elastic band 80 extends along the sides and across the back of the wearer's head, connecting the ends 62, 64 of the strip 60, and snugly yet comfortably holds the band 50 on the wearer's head due to the resistance of the elastic band.

Accordingly, in the embodiment illustrated in FIGS. 2A-2D, the strip 60, when dry, initially measures approximately eight and a half (8½) inches in length, approximately one and a half (1½) inches in width, and approximately one sixteenth ($1/16^{th}$) of an inch in thickness. These measurements are contemplated for an adult sized cap band, but can be varied to accommodate various sized heads. When fully wetted, the compressed cellulose pop-up sponge material expands in thickness or pops-up to approximately five eights ($5/8^{th}$) of an inch thick.

As with the head band 10 of FIGS. 1A-1D, the plurality of holes or passageways 74 formed in the strip 60 could take any suitable shapes or sizes, but preferably are elongated, horizontal ovals measuring approximately one half (½) of an inch in length and approximately one quarter (¼) of an inch in height. Any suitable number of these holes can be cut or punched into the strip in suitable locations along the strip. As illustrated, the strip 60 has twelve (12) of such holes or passageways arranged in two (2) symmetric rows, six (6) holes per row, with three (3) holes to the left of center and three (3) holes to the right of center in each row.

Additionally, the two holes 76, 78 providing the attachment locations for the elastic band 80 connecting end 62 with end 64 are cut or punched into the strip 60 approximately three eights (⅜) of an inch in from the ends of the strip, respectively. These attachment holes 76, 78 are preferably the same size and shape as the other holes 74, but are oriented vertically rather than horizontally.

The elastic band 80 preferably comprises a piece of elastic approximately one half (½) of an inch wide and approximately twelve (12) inches long. The ends of the elastic band 80 are inserted through the attachment holes 76 and 78, respectively, and then an approximately one (1) inch section of each end of the elastic band 80 is doubled over onto itself, each around the respective end of the strip 60. Each doubled over portion of the elastic band 80 is then glued together or otherwise suitably fastened to secure the elastic band 80, now approximately ten (10) inches long, to each end of the strip 60.

Figure 2C:
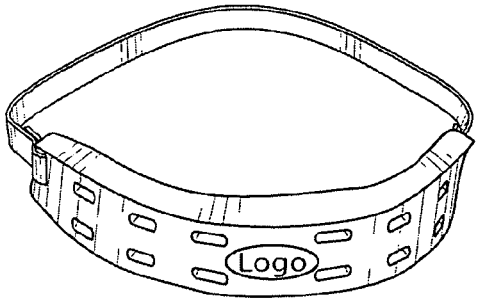
FIG. 2C is a perspective view of the alternate embodiment of the compressed cellulose pop-up sponge head band of the present disclosure, in an expanded state, for use under a wearer's hat or cap.
Figure 2D:
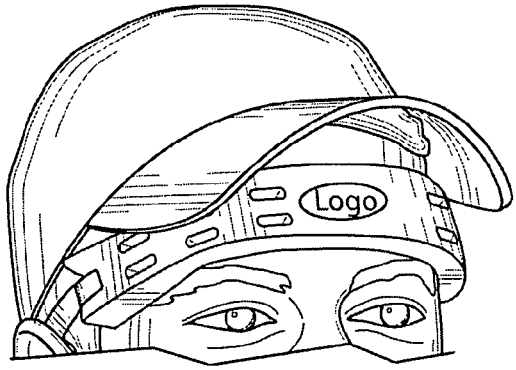
FIG. 2D is a perspective view of the alternate embodiment of the compressed cellulose pop-up sponge head band of the present disclosure, in an expanded state, for use under a wearer's hat or cap, and in use on a wearer's head.

In use, the smaller sponge area of band 50, relative to the head band 10 of FIGS. 1A-1D, under the peak of the cap provides the cooling effect to the wearer's forehead, while the flat elastic band 80 goes under the cap, so as not to interfere with the wearing of the cap. FIG. 2C illustrates the cap band 50 after having been expanded from being wetted with water and/or with perspiration. The user can wear the expanded band 50 comfortably under the cap, without interference, as shown in FIG. 2D, and flip or reverse the band 50 as needed to provide the continuous cooling effect to the wearer, as discussed above.

Figure 3A:
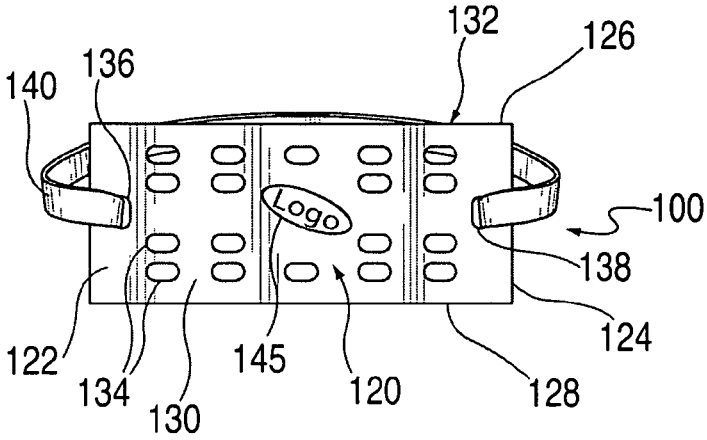
FIG. 3A is a perspective view of a second alternate embodiment of a compressed cellulose pop-up sponge forehead band of the present disclosure, in an unexpanded state.

FIG. 3A illustrates a third embodiment of the present disclosure wherein a compressed cellulose pop-up sponge band 100 takes the form of a forehead band, i.e., a band designed to substantially cover a wearer's entire forehead. The band 100 comprises a generally rectangular strip 120 of compressed cellulose pop-up sponge material. The strip 120 has a first end 122, a second end 124, a first edge 126, a second edge 128, a first surface 130 and a second surface 132 (back side of band in FIG. 3A).

A plurality of holes or passageways 134 are formed in the strip 120. Two additional holes 136, 138 are formed near the ends 122, 124 respectively. These two holes 136, 138 provide the attachment locations for an elastic band 140, which connects end 122 with end 124, as can be seen in FIG. 3A. A logo, name, symbol or other indicia 145 may be printed on or otherwise affixed to one or both of the surfaces 130, 132 of the strip 120, preferably but not necessarily at or near the center of the strip 120.

Figure 3B:
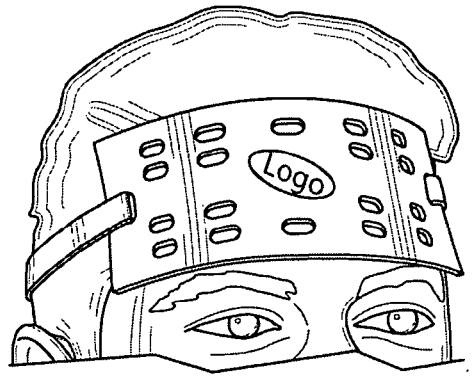
FIG. 3B is a perspective view of the second alternate embodiment of the compressed cellulose pop-up sponge forehead band of the present disclosure, in an unexpanded state, in use on a wearer's forehead.

As can be seen in FIG. 3B, the band 100 is worn as a forehead band, specifically designed to cover substantially the entire forehead area of a wearer. In this embodiment, the strip 120 extends approximately from the end of one of the wearer's eyebrows to the end of the other of the wearer's eyebrows, covering substantially all of the wearer's forehead. Elastic band 140 extends along the sides and across the back of the wearer's head, connecting the ends 122, 124 of the strip 120, and snugly yet comfortably holds the band 100 on the wearer's forehead due to the resistance of the elastic band.

Accordingly, in the embodiment illustrated in FIGS. 3A-3D, the strip 120, when dry, initially measures approximately six (6) inches in length, approximately two and a quarter (2¼) inches in width, and approximately one sixteenth ($1/16^{th}$) of an inch in thickness. These measurements are contemplated for an adult sized forehead band, but can be varied to accommodate various sized foreheads. When fully wetted, the compressed cellulose pop-up sponge material expands in thickness or pops-up to approximately five eights ($5/8^{th}$) of an inch thick.

As with the head bands 10 and 50 of FIGS. 1A-1D and 2A-2D respectively, the plurality of holes or passageways 134 formed in the strip 120 could take any suitable shapes or sizes, but preferably are elongated, horizontal ovals measuring approximately one half ('/2) of an inch in length and approximately one quarter (¼) of an inch in height. Any suitable number of these holes can be cut or punched into the strip in suitable locations along the strip. As illustrated, the strip 120 has eighteen (18) of such holes or passageways arranged in four (4) rows, four (4) or five (5) holes per row, with four (4) holes to the left of center and four (4) holes to the right of center in each row, and one (1) hole at the center in each of the top and bottom row.

Additionally, the two holes 136, 138 providing the attachment locations for the elastic band 140 connecting end 122 with end 124 are cut or punched into the strip 120 approximately three eights (3/8) of an inch in from the ends of the strip, respectively. These attachment holes 136, 138 are preferably the same size and shape as the other holes 134, but are oriented vertically rather than horizontally.

The elastic band 140 preferably comprises a piece of elastic approximately one half (½) of an inch wide and approximately seventeen (17) inches long. The ends of the elastic band 140 are inserted through the attachment holes 136 and 138, respectively, and then an approximately one (1) inch section of each end of the elastic band 140 is doubled over onto itself, each around the respective end of the strip 120. Each doubled over portion of the elastic band 140 is then glued together or otherwise suitably fastened to secure the elastic band 140, now approximately fifteen (15) inches long, to each end of the strip 120.

Figure 3C:
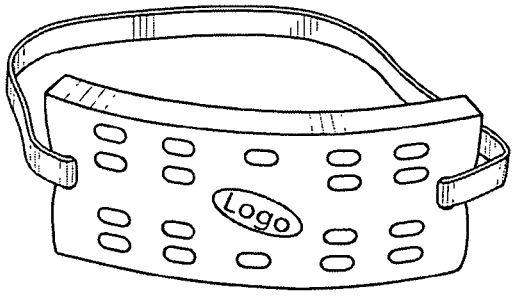
FIG. 3C is a perspective view of the second alternate embodiment of the compressed cellulose pop-up sponge forehead band of the present disclosure, in an expanded state.
Figure 3D:
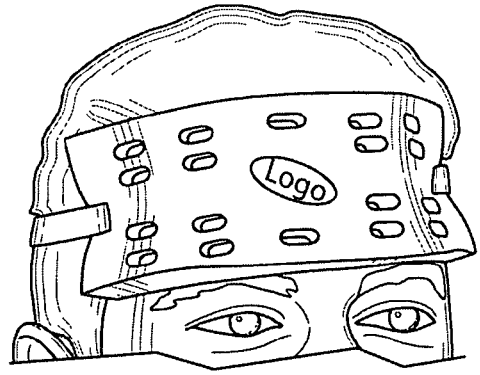
FIG. 3D is a perspective view of the second alternate embodiment of the compressed cellulose pop-up sponge forehead band of the present disclosure, in an expanded state, in use on a wearer's forehead.

In use, the shorter and wider sponge area of band 100, relative to the head bands 10 and 50 of FIGS. 1A-1D ad 2A-2D, covering the forehead provides the cooling effect to the wearer's forehead. FIG. 3C illustrates the forehead band 100 after having been expanded from being wetted with water and/or with perspiration. The user can wear the expanded band 100 comfortably on the forehead, as shown in FIG. 3D, and flip or reverse the band 100 as needed to provide the continuous cooling effect to the wearer, as discussed above.

Accordingly, this forehead band can provide hands free cooling directly to the forehead area when forehead cooling may be desired, for example, by a user lying down on a bed or couch with a fever. In such an instance, typical forehead cooling items such as a cold rag or ice pack must be held against the forehead or risk falling off. Further, such typical forehead cooling items rapidly lose their coolness and must be replaced. However, the reversible forehead band of this embodiment can be repeatedly flipped to place the cooler outer surface against the forehead, bringing the needed cooling back to the forehead, and to expose the warmer, previously inner surface to the elements. The now warmer outer surface will rapidly cool through evaporation as the warm water on the surface promotes evaporation. As the expanded sponge area between the surfaces holds a good supply of water, this process can be repeated numerous times, with little or no outside assistance, and maintain the cooling effect for far longer than the traditional forehead cooling items.

Figure 4A:
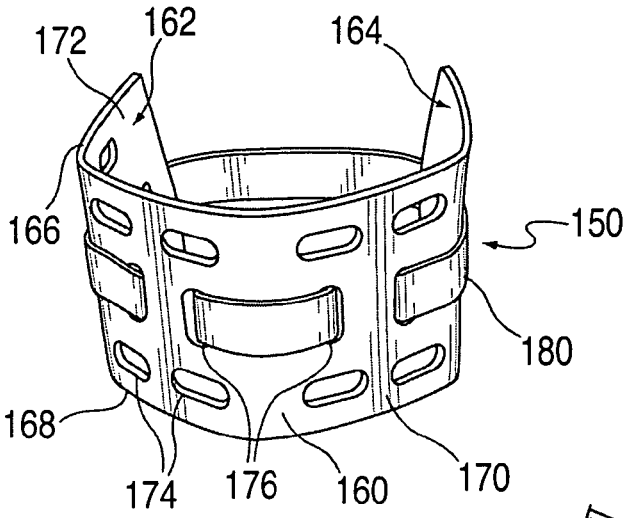
FIG. 4A is a perspective view of a third alternate embodiment of a compressed cellulose pop-up sponge wrist band of the present disclosure, in an unexpanded state.

FIG. 4A illustrates a fourth embodiment of the present disclosure wherein a compressed cellulose pop-up sponge band 150 takes the form of a wrist band, i.e., a band designed to be worn around a user's wrist. The band 150 comprises a generally rectangular strip 160 of compressed cellulose pop-up sponge material. The strip 160 has a first end 162, a second end 164, a first edge 166, a second edge 168, a first surface 170 and a second surface 172.

A plurality of horizontally oriented holes or passageways 174 are formed in the strip 160 along the edges 166 and 168. A plurality of additional holes 176, vertically oriented, are formed along a longitudinal centerline of the strip. These holes 176 provide the attachment locations for an elastic band 180, which connects end 162 with end 164, as can be seen in FIG. 4A.

Figure 4B:
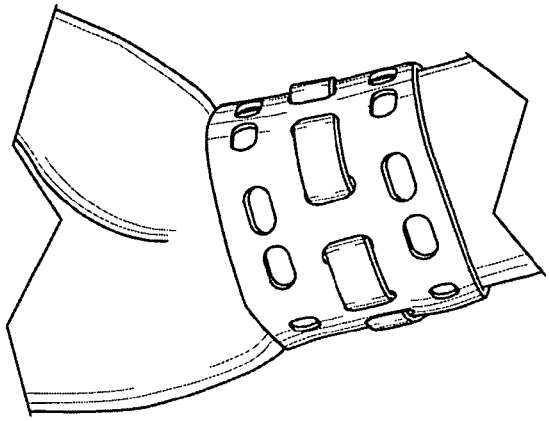
FIG. 4B is a perspective view of the third alternate embodiment of the compressed cellulose pop-up sponge wrist band of the present disclosure, in an unexpanded state, in use on a wearer's wrist.

As can be seen in FIG. 4B, the band 150 is worn as a wrist band, specifically designed to fit around a wearer's wrist. In this embodiment, the strip 160 encircles approximately 75% of the wearer's wrist. Elastic band 180 is weaved through holes 176 of the wrist band and then secured together at its ends, thus connecting the ends 162, 164 of the strip 160, and snugly yet comfortably holds the band 150 on the wearer's wrist due to the resistance of the elastic band.

Accordingly, in the embodiment illustrated in FIGS. 4A-4D, the strip 160, when dry, initially measures approximately six (6) inches in length, approximately two (2) inches in width, and approximately one sixteenth ($1/16^{th}$) of an inch in thickness. These measurements are contemplated for an adult sized wrist, but can be varied to accommodate various wrists. When fully wetted, the compressed cellulose pop-up sponge material expands in thickness or pops-up to approximately five eights ($5/8^{th}$) of an inch thick.

As with the bands of FIGS. 1A-1D, 2A-2D and 3A-3D, the plurality of holes or passageways 174 formed in the strip 160 could take any suitable shapes or sizes, but preferably are elongated, horizontal ovals measuring approximately one half (A) of an inch in length and approximately one quarter (') of an inch in height. Any suitable number of these holes can be cut or punched into the strip in suitable locations along the strip. As illustrated, the strip 160 has twelve (12) of such holes or passageways arranged in two (2) symmetric rows, six (6) holes per row.

Additionally, the attachment holes 176 are preferably similar in shape as the other holes 174, but are oriented vertically rather than horizontally. These holes 176 are sized substantially to the size of the width of the elastic band 180. As illustrated, the strip 160 has eight (8) of such holes or passageway arranged in a single row.

The elastic band 180 preferably comprises a piece of elastic approximately one half (A) of an inch wide and approximately nine (9) inches long. One end of the elastic band 180 is weaved through the attachment holes 176, and then an approximately one (1) inch section of each end of the elastic band 180 is overlapped. This overlapped portion of the elastic band 180 is then glued together or otherwise suitably fastened to secure the elastic band 180, now approximately eight (8) inches long, to the strip 160. Thus, there is approximately a two inch section of the band 180 connecting end 162 with end 164.

Figure 4C:
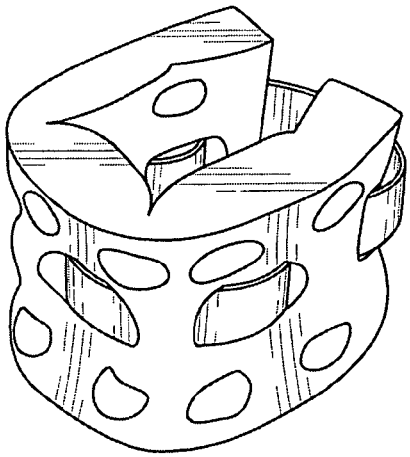
FIG. 4C is a perspective view of the third alternate embodiment of the compressed cellulose pop-up sponge wrist band of the present disclosure, in an expanded state.
Figure 4D:
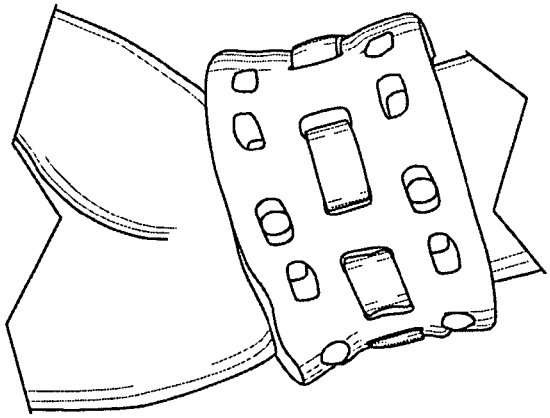
FIG. 4D is a perspective view of the third alternate embodiment of the compressed cellulose pop-up sponge wrist band of the present disclosure, in an expanded state, in use on a wearer's wrist.

In use, the wrist band 150 is placed around the wearer's wrist to provide the cooling effect to the wearer's wrist through the above described water/perspiration evaporation process. FIG. 4C illustrates the wrist band 150 after having been expanded from being wetted with water and/or with perspiration. The user can wear the expanded band 150 comfortably on the wrist, as shown in FIG. 4D, and flip or reverse the band 150 as needed to provide the continuous cooling effect to the wearer, as discussed above. The wetted wrist band can also provide a soft wet sponge handily on the wearer's wrist, allowing the wearer to wipe the wearer's forehead, face, or other part of the wearer's exposed skin.

Figure 5A:
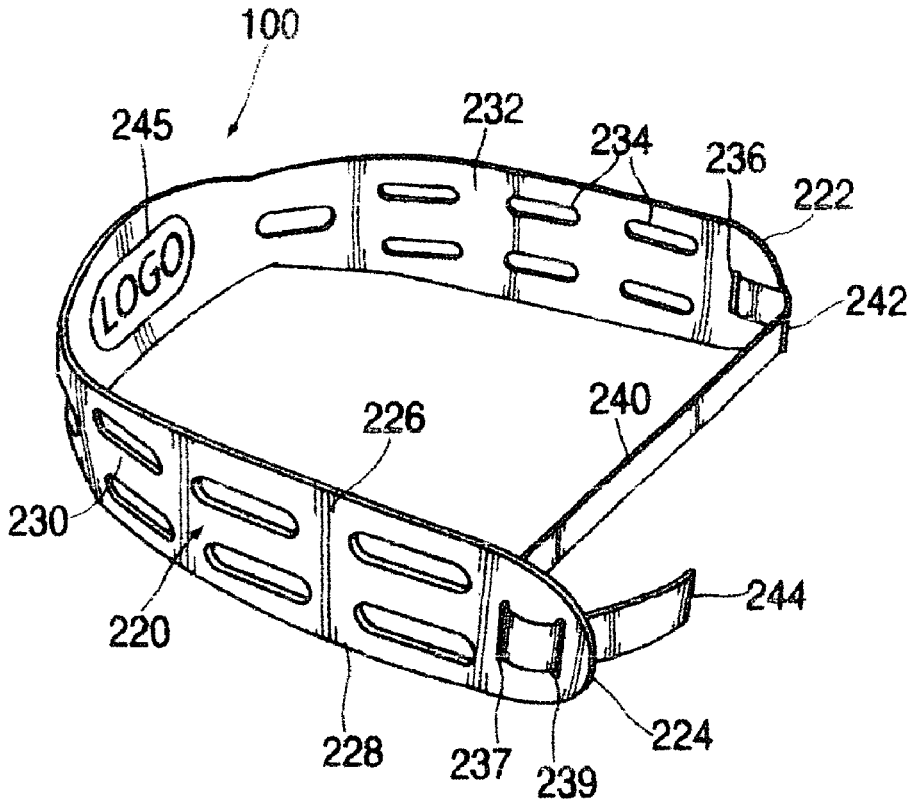
FIG. 5A is a perspective view of a fourth alternate embodiment of a compressed cellulose pop-up sponge head band of the present disclosure, in an unexpanded state, having an adjustable band.

FIG. 5A illustrates a fourth embodiment of the present disclosure wherein a compressed cellulose pop-up sponge band 200 takes the form of a head band. The band 200 comprises a generally rectangular strip 220 of compressed cellulose pop-up sponge material, having rounded corners and two tapered or narrow portions a short distance off center, which tend to accentuate the center portion therebetween. The strip 220 has a first end 222, a second end 224, a first edge 226, a second edge 228, a first surface 230 and a second surface 232. A logo, name, symbol or other indicia 245 may be printed on or otherwise affixed to one or both of the surfaces 230, 232 of the strip 220, preferably but not necessarily at or near the center of the strip 220.

A plurality of holes or passageways 234 are formed in the strip 220. One additional hole 236 is formed near first end 222, and two additional holes 237 and 239 are formed near the second end 224. These three holes 236, 237 and 239 provide the attachment locations for an elastic band 240, which connects end 222 with end 224. Specifically, hole 236 attaches one end 242 of the elastic band 240 in the same manner as previously described in the other embodiments described above. However, in this embodiment, the elastic band 240 is adjustable, in the following "one-size-fits-all" manner.

Figure 5B:
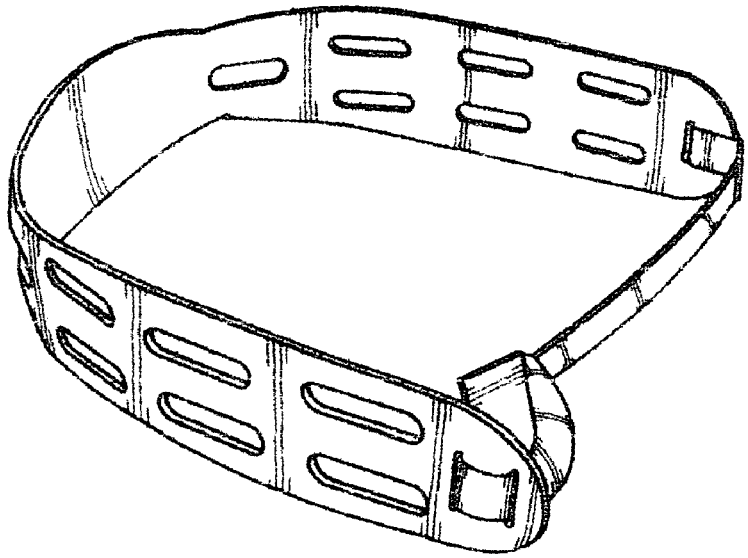
FIG. 5B is a perspective view of the fourth alternate embodiment of the compressed cellulose pop-up sponge head band of the present disclosure, in an unexpanded state, illustrating the fastening of the adjustable band.

The other end 244 of the elastic band 240 initially is a free or loose end. This free or loose end 244 is then inserted through holes 237 and 239 (as shown in FIG. 5A). The band 200 is placed on the user's head and the user pulls the elastic band 240 through the two holes 237, 239 until it becomes the size that comfortably fits the user's head. Friction on the elastic band 240 when placed through the two holes 237, 239 is generally sufficient to secure the head band 200 on the wearer's head during use, especially once the head band 200 becomes wet and the compressed cellulose material expands. The elastic band 240 however can subsequently be knotted to further secure end 244 to the head band 200 (as can be seen in FIG. 5B), for example during more extreme use.

Accordingly, the head band 220 is easily adjustable as desired by the user to a size which will comfortably fit the user's head. Adjustability is determined by the amount of the free end 244 which is inserted though the holes 237 and 239. The farther end 244 is inserted through these holes, the tighter the head band 200 will become.

The free end 244 of the elastic band 240 can be knotted in any suitable manner. For example, end 244 can be inserted through hole 237 from the second surface 232, and then inserted through hole 239 from the first surface 230. A knot such as a half hitch can then be formed by looping the free end 244 around the elastic band 240, either over first then around and back up, or under first then around and back down, as should be commonly understood in tying a knot, specifically a half hitch. Alternatively, the free end 244 could be inserted first though hole 239 from the second surface 232, and then inserted through hole 237 from the first surface 230, and then knotted as discussed above. Further, free end 244 can be inserted through hole 237 from the first surface 230, and then inserted through hole 239 from the second surface 232, and then knotted. Alternatively, the free end 244 could be inserted first though hole 239 from the first surface 230, and then inserted through hole 237 from the second surface 232, and then knotted.

It does not make a significant difference from which side the free end is first inserted since the head band is reversible and can be flipped, as discussed above. In any event, the half hitch knot will lie generally flat and will be substantially unnoticeable by the wearer.

Accordingly, it should be readily apparent that the head band 200 can be easily and quickly adjusted to a wearer's preference. It should also be understood that a single hole could take the place of the two holes 237, 239, and that a knot could be formed after the free end 244 is placed through the single hole. Further, both ends of the elastic band 240 could be free ends, and a knot could be formed at both ends.

In the embodiment illustrated in FIGS. 5A-5B, the strip 220, when dry, initially measures approximately sixteen and seven eighths (16⅞) inches in length, and approximately one sixteenth ($1/16^{th}$) of an inch in thickness. At its widest point, the strip measures approximately one and a half (1½) inches in width. As can be seen, however, the strip 220 includes two tapered or narrowed portions which measure approximately one (1) inch in width. These measurements are contemplated for an adult sized head band, but can be varied to accommodate various sized heads. When fully wetted, the compressed cellulose pop-up sponge material expands in thickness or pops-up to approximately five eights ($5/8^{th}$) of an inch thick.

As before, the plurality of holes or passageways 234 formed in the strip 220 could take any suitable shapes or sizes, but preferably include twelve (12) elongated, horizontal ovals measuring approximately one (1) inch in length and approximately one quarter (¼) of an inch in height, and two (2) elongated, horizontal ovals measuring approximately one (1) inch in length and approximately three eights ($3/8^{th}$) of an inch in height. Any suitable number of these holes can be cut or punched into the strip in suitable locations along the strip. As illustrated, the strip 220 has on each side of its center, six (6) of the narrower holes arranged in two (2) symmetric rows, three (3) holes per row, and one (1) of the wider holes centrally located just off center. The center portion of the strip 220, from wider hole to wider hole is approximately four (4) inches in length.

Additionally, hole 236 providing the attachment location for the end 242 of elastic band 240 is a vertical oval measuring approximately one half (½) inch in height and one quarter (¼) inch in width, and is cut or punched into the strip 220 approximately three eights (⅜) of an inch in from the end 222 of the strip. The two holes 237 and 239 providing the attachment location for the free end 244 of the elastic band 240 are vertical ovals measuring approximately one half (½) inch in height and three thirty seconds ($3/32^{th}$) of an inch in width, and are cut or punched into the strip 220 approximately one quarter (¼) and three quarters (¾) of an inch in from the end 224 of the strip 220, respectively.

Accordingly, it should be understood from the above embodiments that the compressed cellulose pop-up sponge band of the present disclosure provides a thin, lightweight, washable, reusable and disposable band which is inexpensive and easy to manufacture, and easy to use and to store while not in use.

It is to be understood that the embodiment(s) herein described is/are merely illustrative of the principles of the present invention. Various modifications may be made by those skilled in the art without departing from the spirit or scope of the claims which follow. For example, it is foreseen that any suitable compressed cellulose or sponge-like material may be used to make the band of the present disclosure, so long as it accomplishes the function, purposes and/or advantages of the invention disclosed herein. The band can take any size and shape and need not be rectangular, but could also be oval, tapered, etc., and can be used on any part of the body, for example knees, elbows, etc. Similarly, the holes or passageways can be any suitable number, location, size and shape so long as they provide a suitable channel for air flow (e.g., substantially larger than perforations), and increase the surface area of the sponge-like material for accelerated evaporation purposes. For example, the holes or passageways could be cut into shapes such as circles, squares, triangles, etc., or symbols such as stars, crowns, logos, etc., or they could be cut into letters or numbers to spell words, names, phone numbers, etc., or any combination of the same. Other similar variations are contemplated.

What is claimed is:

1. A headband for absorbing moisture and cooling a user through evaporation, the headband comprising:

an elastic band having a first side, a second side, a front, a back and a length;

a generally rectangular strip of a compressed cellulose wherein the generally rectangular strip of compressed cellulose has a front, a back, a first side, a second side, a top, a bottom and a width and wherein the generally rectangular strip of a compressed cellulose is flexible and expands when a liquid is absorbed;

a first opening located at the first side of the generally rectangular strip of compressed cellulose and a second opening located at the second side of the generally rectangular strip of compressed cellulose wherein the first side of the elastic band is at least partly inserted through and is secured within the first opening of the generally rectangular strip of compressed cellulose and wherein the second side of the elastic band is at least partly inserted through and is secured within the second opening of the generally rectangular strip of compressed cellulose; and a plurality of uniform openings in the generally rectangular strip of a compressed cellulose wherein the plurality of uniform openings extend in a direct path from the front of the generally rectangular strip of a compressed cellulose, through the width of the generally rectangular strip of a compressed cellulose to the back of the generally rectangular strip of a compressed cellulose wherein the plurality of uniform openings exposes a portion of skin of a user directly to the outside elements and allows for direct airflow and evaporation of sweat and wherein the plurality of uniform openings of the generally rectangular strip of compressed cellulose measure approximately one half of an inch in length and approximately one quarter of an inch in height.

2. The headband of claim 1 wherein capillary action of the plurality of uniform openings of the generally rectangular strip of compressed cellulose allows for the absorption and evaporation of sweat or moisture from the user to the environment.

3. The headband of claim 1 wherein the headband is reversible such that the front may be flipped and may become the back therein increasing the rate of evaporation.

4. The headband of claim 1 wherein indicia is located on the front or back of the generally rectangular strip of a compressed cellulose.

5. The headband of claim 1 wherein the back of the generally rectangular strip of a compressed cellulose absorbs sweat from a forehead of a user while simultaneously the front of the generally rectangular strip of a compressed cellulose allows for evaporation of sweat and dissipation of heat.

* * * * *